US006722157B1

(12) United States Patent
Eaton et al.

(10) Patent No.: US 6,722,157 B1
(45) Date of Patent: Apr. 20, 2004

(54) NON-VOLATILE NATURAL GAS LIQUEFACTION SYSTEM

(75) Inventors: Anthony P. Eaton, Sugar Land, TX (US); Bobby D. Martinez, Missouri City, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 10/393,472

(22) Filed: Mar. 20, 2003

(51) Int. Cl.[7] ..... F25J 1/00
(52) U.S. Cl. ..... 62/612; 62/613
(58) Field of Search ..... 62/612, 613, 611

(56) References Cited

U.S. PATENT DOCUMENTS 4,548,629 A 10/1985 Chiu
5,473,900 A * 12/1995 Low ..... 62/611
5,611,216 A 3/1997 Low et al.
6,023,942 A 2/2000 Thomas et al.
6,158,240 A 12/2000 Low et al.
6,250,105 B1 6/2001 Kimble
2003/0089125 A1 * 5/2003 Fredheim et al. ..... 62/612

FOREIGN PATENT DOCUMENTS

WO 0169149 9/2001

* cited by examiner

*Primary Examiner*—William C. Doerrler
(74) *Attorney, Agent, or Firm*—Kameron D. Kelly

(57) ABSTRACT

A system for liquefying natural gas by cooling the natural gas stream in a first refrigeration cycle employing a non-volatile refrigerant, such as carbon dioxide, and subsequently cooling the natural gas stream in a second refrigeration cycle employing a predominately methane refrigerant.

53 Claims, 2 Drawing Sheets

NON-VOLATILE NATURAL GAS LIQUEFACTION SYSTEM

BACKGROUND OF THE INVENTION

1. Field of the Invention

Figure 1:
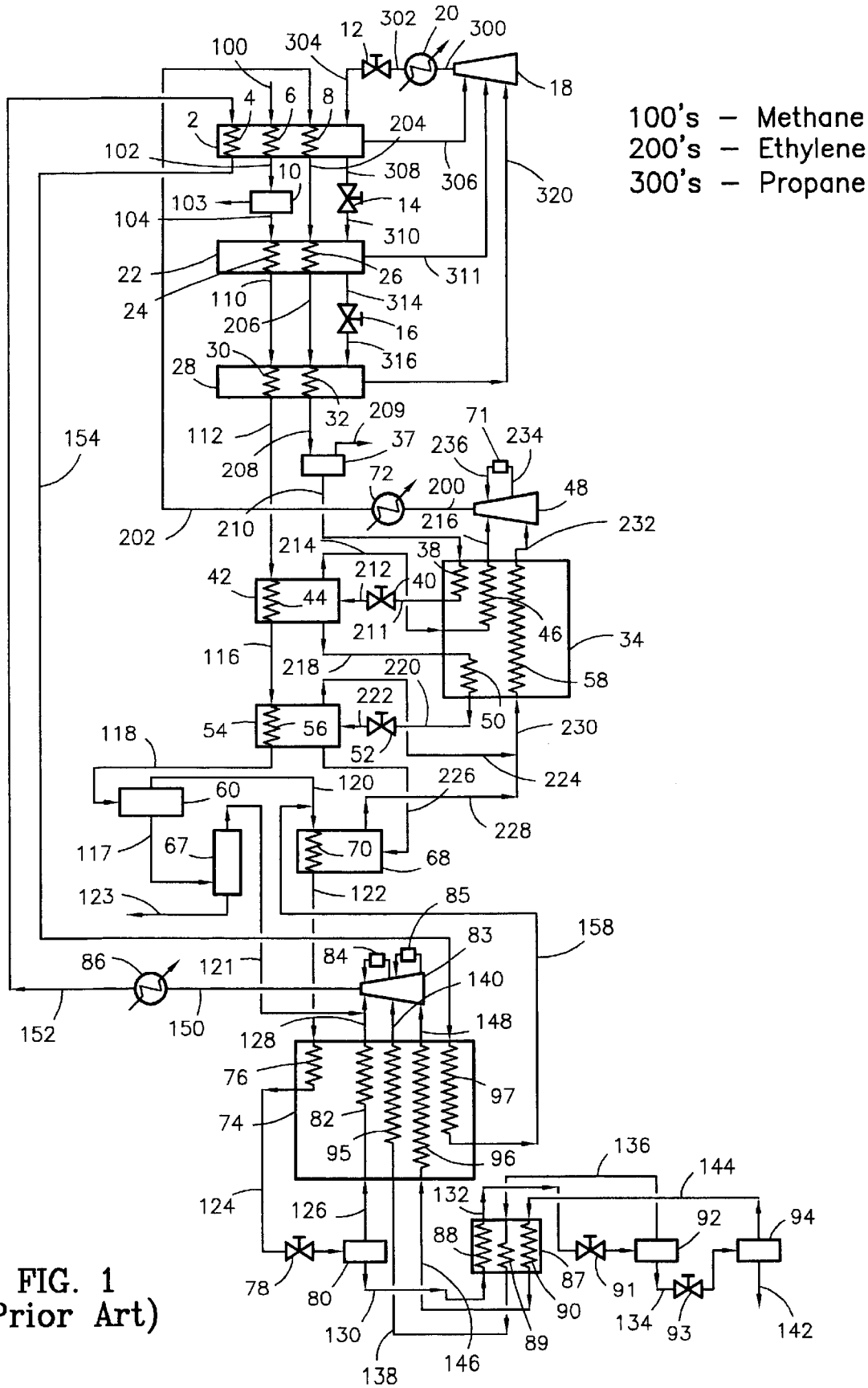
FIG. 1 (Prior Art)

The present invention relates generally to a natural gas liquefaction system that employs a non-volatile refrigerant in one or more of its main refrigeration cycles. In another aspect, the invention concerns a cascade-type natural gas liquefaction system that employs carbon dioxide as the primary refrigerant in at least one of its main refrigeration cycles.

2. Description of the Prior Art

It is common practice to cryogenically liquefy natural gas for transport and storage. The primary reason for the liquefaction of natural gas is that liquefaction results in a volume reduction of about 1/600, thereby making it possible to store and transport the liquefied gas in containers of more economical and practical design. For example, when gas is transported by pipeline from the source of supply to a distant market, it is desirable to operate the pipeline under a substantially constant and high load factor. Often the deliverability or capacity of the pipeline will exceed demand while at other times the demand may exceed the deliverability of the pipeline. In order to shave off the peaks where demand exceeds supply, it is desirable to store the excess gas in such a manner that it can be delivered when the supply exceeds demand, thereby enabling future peaks in demand to be met with material from storage. One practical means for doing this is to convert the gas to a liquefied state for storage and to then vaporize the liquid as demand requires.

Liquefaction of natural gas is of even greater importance in making possible the transport of gas from a supply source to market when the source and market are separated by great distances and a pipeline is not available or is not practical. This is particularly true where transport must be made by ocean-going vessels. Ship transportation in the gaseous state is generally not practical because appreciable pressurization is required to significantly reduce the specific volume of the gas which in turn requires the use of more expensive storage containers.

In order to store and transport natural gas in the liquid state, the natural gas is preferably cooled to −240° F. to −260° F. where it possesses a near-atmospheric vapor pressure. Numerous systems exist in the prior art for the liquefaction of natural gas by sequentially passing the gas at an elevated pressure through a plurality of cooling stages whereupon the gas is cooled to successively lower temperatures until the liquefaction temperature is reached. Cooling is generally accomplished by heat exchange with one or more refrigerants such as propane, propylene, ethane, ethylene, and methane or a combination of one or more of the preceding. In the art, the refrigerants are frequently arranged in a cascaded manner and each refrigerant is employed in a closed refrigeration cycle. Further cooling of the liquid is possible by expanding the liquefied natural gas to atmospheric pressure in one or more expansion stages. In each stage, the liquefied gas is flashed to a lower pressure thereby producing a two-phase gas-liquid mixture at a significantly lower temperature. The liquid is recovered and may again be flashed. In this manner, the liquefied gas is further cooled to a storage or transport temperature suitable for liquefied gas storage at near-atmospheric pressure. In this expansion to near-atmospheric pressure, some additional volumes of liquefied gas are flashed. The flashed vapors from the expansion stages are generally collected and recycled for liquefaction or utilized as fuel gas for power generation.

One disadvantage of conventional LNG production facilities is their use of volatile hydrocarbon-based refrigerants to cool the natural gas. The use of such volatile hydrocarbon-based refrigerants necessitates the presence of expensive safety equipment to guard against catastrophe in the event of refrigerant leakage and/or ignition. The use of volatile hydrocarbon-base refrigerants can be especially disadvantageous when the LNG facility is located offshore. Offshore LNG plants employing volatile hydrocarbon-based refrigerants must take extra precautions to ensure that there is no leakage of the hydrocarbon-based refrigerants, which could necessitate dangerous and expensive cleanup actions.

As with all hydrocarbon production and processing facilities, capital expense and operating expense are key factors in determining the economic feasibility of a LNG plant. Thus, design engineers are always looking for ways to decrease capital expense by eliminating unnecessary equipment. Further, design engineers are constantly search for ways to reduce operating expense by making the plant run more efficiently.

OBJECTS AND SUMMARY OF THE INVENTION

It is, therefore, an object of the present invention to provide a LNG facility having a reduced amount of volatile refrigerants employed therein.

Another object of the invention is to provide a natural gas liquefaction system having enhanced efficiency, thereby reducing operating expense.

Yet another object of the invention is to provide a natural gas liquefaction system having a reduced number of vessels and equipment, thereby reducing capital expense.

It should be noted that the above-listed objects of the invention need not all be accomplished by the invention claimed herein. In addition, other objects and advantages of the present invention will be readily recognized by one skilled in the art in view of the following detailed description of the preferred embodiments, drawing figures, and claims.

In one embodiment of the present invention, there is provided a process for liquefying natural gas comprising the steps of: (a) cooling a natural gas stream in a first refrigeration cycle employing a first refrigerant comprising predominately carbon dioxide; and (b) downstream of the first refrigeration cycle, further cooling the natural gas stream in a second refrigeration cycle employing a second refrigerant comprising predominately methane.

In another embodiment of the invention, there is provided a process for liquefying natural gas comprising the steps of: (a) cooling a natural gas stream in a carbon dioxide refrigeration cycle employing a plurality of separate chillers for sequentially transferring heat from the natural gas stream to a carbon dioxide refrigerant comprising predominately carbon dioxide, said carbon dioxide refrigeration cycle including a carbon dioxide compressor for increasing the pressure of the carbon dioxide refrigerant to a discharge pressure of at least about 900 psia; and (b) downstream of the carbon dioxide refrigeration cycle, further cooling the natural gas stream in a methane refrigeration cycle employing a methane refrigerant comprising predominately methane.

In still another embodiment of the invention, there is provided a process for liquefying natural gas comprising the steps of: (a) cooling a natural gas stream in a carbon dioxide refrigeration cycle employing a plurality of separate chillers for sequentially transferring heat from the natural stream to a carbon dioxide refrigerant comprising predominately carbon dioxide, said carbon dioxide refrigeration cycle including a carbon dioxide compressor for increasing the pressure of the carbon dioxide refrigerant to a discharge pressure of at least about 800 psia; (b) downstream of the carbon dioxide refrigeration cycle, further cooling the natural gas stream in an ethylene refrigeration cycle employing an ethylene refrigerant comprising predominately ethylene; and (c) downstream of the ethylene refrigeration cycle, further cooling the natural gas stream in a methane refrigeration cycle employing a methane refrigerant comprising predominately methane.

In a further embodiment of the present invention, there is provided a LNG plant for liquefying a natural gas stream. The LNG plant comprises a carbon dioxide refrigeration cycle and a methane refrigeration cycle. The carbon dioxide refrigeration cycle comprises a carbon dioxide compressor, a carbon dioxide chiller, and a carbon dioxide refrigerant comprising predominately carbon dioxide. The carbon dioxide compressor is operable to increase the pressure of the carbon dioxide refrigerant. The carbon dioxide chiller is operable to transfer heat from the natural gas stream to the carbon dioxide refrigerant. The methane refrigeration cycle comprises a methane compressor, a methane chiller, and a methane refrigerant comprising predominately methane. The methane compressor is operable to increase the pressure of the methane refrigerant. The methane chiller is operable to transfer heat from the natural gas stream to the methane refrigerant.

BRIEF DESCRIPTION OF THE DRAWING FIGURES

Figure 2:
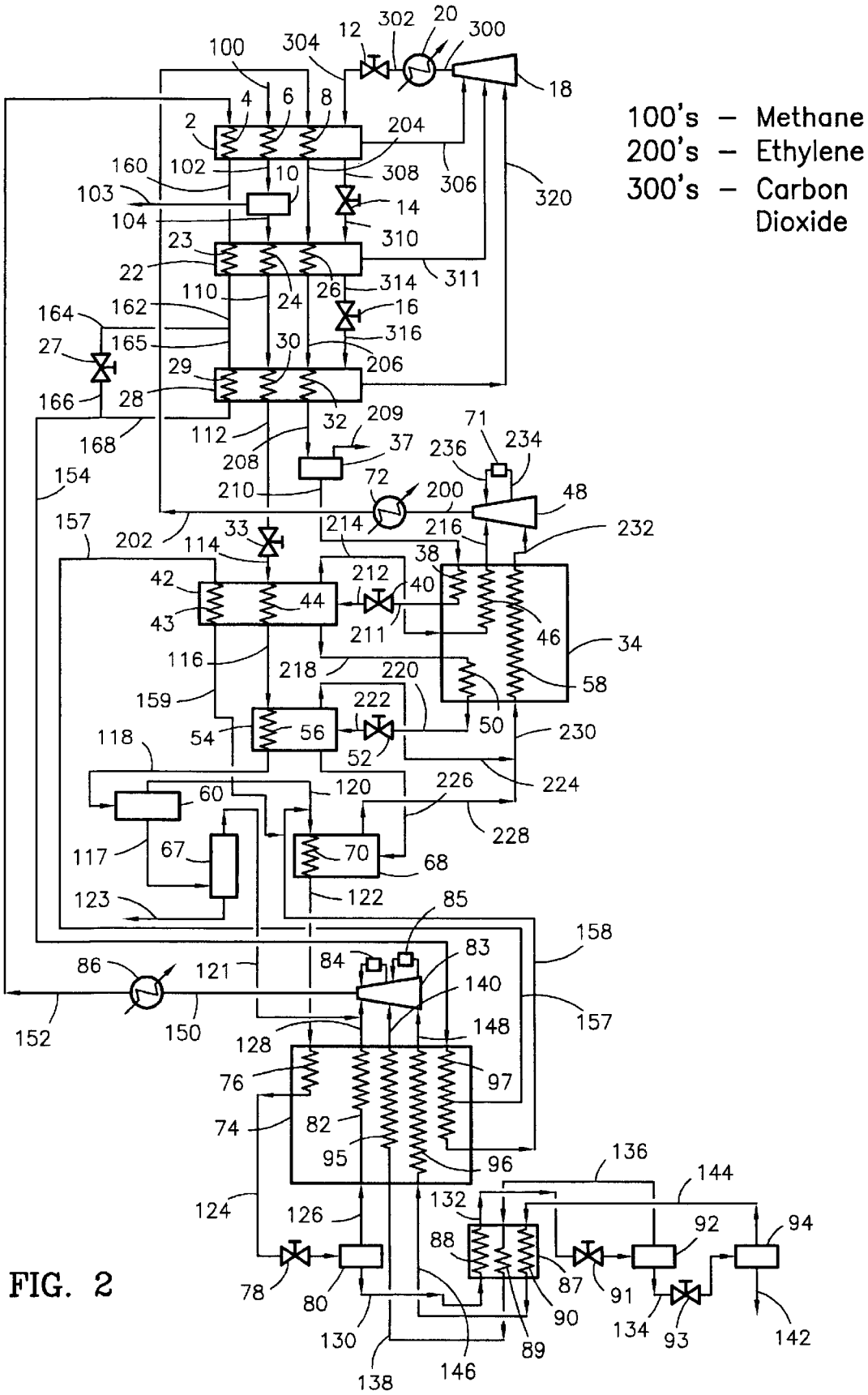

Embodiments of the present invention are described in detail below with reference to the attached drawing figures, wherein:

FIG. 1 is a simplified flow diagram of a prior art cryogenic LNG production plant; and FIG. 2 is a simplified flow diagram of an inventive cryogenic LNG production plant constructed in accordance with a first embodiment of the present invention and employing sequential carbon dioxide, ethylene, and methane refrigeration cycles.

DETAILED DESCRIPTION OF THE PREFERRED EMBODIMENTS

Referring initially to FIG. 1, a prior art open-cycle cascade-type LNG plant is illustrated. Those skilled in the art will recognized that FIG. 1 is a schematic only and therefore, many items of equipment that would be needed in a commercial plant for successful operation have been omitted for the sake of clarity. Such items might include, for example, compressor controls, flow and level measurements and corresponding controllers, additional temperature and pressure controls, pumps, motors, filters, additional heat exchangers, valves, etc. These items would be provided in accordance with standard engineering practice.

The prior art LNG plant illustrated in FIG. 1 is similar to the LNG plant described in U.S. Pat. No. 5,611,216, assigned to Phillips Petroleum Company, the entire disclosure of which is incorporated herein by reference. In general, the LNG plant of FIG. 1 uses three refrigeration cycles followed by an expansion cycle to sequentially cool the natural gas stream. The first refrigeration cycle employs a refrigerant comprising predominately propane, propylene, or mixtures thereof. Preferably, the refrigerant of the first refrigeration cycle comprises at least about 75 mole percent propane, still more preferably at least 90 mole percent propane, and most preferably the refrigerant consists essentially of propane. Streams comprising predominately propane/propylene are carried through conduits labeled with reference numerals in the 300's in FIG. 1. The second refrigeration cycle employs a refrigerant comprising predominately ethylene, ethane, or mixtures thereof. Preferably, the refrigerant of the second refrigeration cycle comprises at least about 75 mole percent ethylene, still more preferably at least 90 mole percent ethylene, and most preferably the refrigerant consists essentially of ethylene. Streams comprising predominately ethane/ethylene are carried through conduits labeled with reference numerals in the 200's in FIG. 1. The third refrigeration cycle employs a refrigerant comprising predominately methane. Preferably, the refrigerant of the third refrigeration cycle comprises at least about 75 mole percent methane, still more preferably at least 90 mole percent methane, and most preferably the refrigerant consists essentially of methane. Streams comprising predominately methane are carried through conduits labeled with reference numerals in the 100's in FIG. 1. Thus, FIG. 1 illustrates that the second (i.e., ethylene) refrigeration cycle is located downstream of the first (i.e., propane) refrigeration cycle, the third (i.e., methane) refrigeration cycle is located downstream of the second (i.e., ethylene) refrigeration cycle, and the expansion cycle is located downstream of the third (i.e., methane) refrigeration cycle. As used herein, the terms "upstream" and "downstream" shall denote the relative positions of various systems of a natural gas liquefaction plant along the main (i.e., most direct) flow path of natural gas through the plant.

The operation of the prior art LNG facility shown in FIG. 1 is described in detail below. In order to avoid unnecessary duplication of disclosure and to minimize the length of this document, the common systems of the prior art LNG facility (FIG. 1) and the inventive LNG facility (FIG. 2) will not be re-described in the sections discussing the inventive embodiments. Thus, unless otherwise described, the common components of the inventive embodiments (FIG. 2) and the prior art facility (FIG. 1) should be assumed to operate in substantially the same manner.

Referring to FIG. 1, gaseous propane is compressed in a multistage compressor 18 driven by a gas turbine driver (not illustrated). The three stages of compression preferably exist in a single unit although each stage of compression may be a separate unit and the units mechanically coupled to be driven by a single driver. Upon compression, the compressed propane is passed through conduit 300 to a cooler 20 where it is liquefied. A representative pressure and temperature of the liquefied propane refrigerant prior to flashing is about 100° F. and about 190 psia. The stream from cooler 20 is passed through conduit 302 to a pressure reduction means, illustrated as expansion valve 12, wherein the pressure of the liquefied propane is reduced, thereby evaporating or flashing a portion thereof. The resulting two-phase product then flows through conduit 304 into a high-stage propane chiller 2 wherein gaseous methane refrigerant introduced via conduit 152, natural gas feed introduced via conduit 100, and gaseous ethylene refrigerant introduced via conduit 202 are respectively cooled via indirect heat exchange means 4, 6, and 8, thereby producing cooled gas streams respectively produced via conduits 154, 102, and 204. The gas in conduit 154 is fed to a main methane economizer 74 which will be discussed in greater detail in a subsequent section and wherein the stream is cooled via indirect heat exchange means 97. The resulting cooled compressed methane recycle stream produced via conduit 158 is then combined in conduit 120 with a heavies depleted vapor stream from a heavies removal column 60 and fed to a condenser 68.

The propane gas from chiller 2 is returned to compressor 18 through conduit 306. This gas is fed to the high stage inlet port of compressor 18. The remaining liquid propane is passed through conduit 308, the pressure further reduced by passage through a pressure reduction means, illustrated as expansion valve 14, whereupon an additional portion of the liquefied propane is flashed. The resulting two-phase stream is then fed to an intermediate stage propane chiller 22 through conduit 310 thereby providing a coolant for chiller 22. The cooled feed gas stream from chiller 2 flows via conduit 102 to a knock-out vessel 10 wherein gas and liquid phases are separated. The liquid phase, which is rich in $C_3$+ components, is removed via conduit 103. The gaseous phase is removed via conduit 106 fed to propane chiller 22. Ethylene refrigerant from chiller 2 is introduced to chiller 22 via conduit 204. In chiller 22, the feed gas stream, also referred to herein as a methane-rich stream, and the ethylene refrigerant streams are respectively cooled via indirect heat transfer means 24 and 26, thereby producing cooled methane-rich and ethylene refrigerant streams via conduits 110 and 206. The thus evaporated portion of the propane refrigerant is separated and passed through conduit 311 to the intermediate-stage inlet of compressor 18. Liquid propane refrigerant from chiller 22 is removed via conduit 314, flashed across a pressure reduction means, illustrated as expansion valve 16, and then fed to third-stage chiller 28 via conduit 316.

As illustrated in FIG. 1, the methane-rich stream flows from intermediate-stage propane chiller 28 to low-stage propane chiller/condenser 28 via conduit 110. In chiller 28, the stream is cooled via indirect heat exchange means 30. In a like manner, the ethylene refrigerant stream flows from the intermediate-stage propane chiller 22 to low-stage propane chiller/condenser 28 via conduit 206. In the latter, the ethylene refrigerant is totally condensed or condensed in nearly its entirety via indirect heat exchange means 32. The vaporized propane is removed from low-stage propane chiller/condenser 28 and returned to the low-stage inlet of compressor 18 via conduit 320.

As illustrated in FIG. 1, the methane-rich stream exiting low-stage propane chiller 28 is introduced to high-stage ethylene chiller 42 via conduit 112. Ethylene refrigerant exits low-stage propane chiller 28 via conduit 208 and is preferably fed to a separation vessel 37 wherein light components are removed via conduit 209 and condensed ethylene is removed via conduit 210. The ethylene refrigerant at this location in the process is generally at a temperature of about −24° F. and a pressure of about 285 psia. The ethylene refrigerant, via conduit 210, then flows to an ethylene economizer 34 wherein it is cooled via indirect heat exchange means 38 and removed via conduit 211 and passed to a pressure reduction means, illustrated as an expansion valve 40, whereupon the refrigerant is flashed to a preselected temperature and pressure and fed to high-stage ethylene chiller 42 via conduit 212. Vapor is removed from chiller 42 via conduit 214 and routed to ethylene economizer 34 wherein the vapor functions as a coolant via indirect heat exchange means 46. The ethylene vapor is then removed from ethylene economizer 34 via conduit 216 and feed to a high-stage inlet of ethylene compressor 48. The ethylene refrigerant which is not vaporized in high-stage ethylene chiller 42 is removed via conduit 218 and returned to ethylene economizer 34 for further cooling via indirect heat exchange means 50, removed from ethylene economizer via conduit 220, and flashed in a pressure reduction means, illustrated as expansion valve 52, whereupon the resulting two-phase product is introduced into a low-stage ethylene chiller 54 via conduit 222.

A methane-rich stream is removed from high-stage ethylene chiller 42 via conduit 116. This stream is then condensed in part via cooling provided by indirect heat exchange means 56 in low-stage ethylene chiller 54, thereby producing a two-phase stream which flows via conduit 118 to heavies removal column 60. A heavies-rich liquid stream containing a significant concentration of $C_4$+ hydrocarbons, such as benzene, cyclohexane, other aromatics, and/or heavier hydrocarbon components, is removed from heavies removal column 60 via conduit 117. The heavies-rich stream in conduit 117 is subsequently separated into liquid and vapor portions or preferably is flashed or fractionated in vessel 67. A liquid stream rich in heavies is produced via conduit 123 and a second methane-rich vapor stream is produced via conduit 121. The stream in conduit 121 is subsequently combined with a second stream delivered via conduit 128, and the combined stream fed to the high pressure inlet port on the methane compressor 83 via conduit 128.

As previously noted, the gas in conduit 154 is fed to main methane economizer 74 wherein the stream is cooled via indirect heat exchange means 97. The resulting cooled compressed methane recycle or refrigerant stream in conduit 158 is combined in the preferred embodiment with the heavies-depleted vapor stream from heavies removal column 60, delivered via conduit 120, and fed to a low-stage ethylene condenser 68. In low-stage ethylene condenser 68, this stream is cooled and condensed via indirect heat exchange means 70 with the liquid effluent from low-stage ethylene chiller 54 which is routed to low-stage ethylene condenser 68 via conduit 226. The condensed methane-rich product from low-stage condenser 68 is produced via conduit 122. The vapor from low-stage ethylene chiller 54, withdrawn via conduit 224, and low-stage ethylene condenser 68, withdrawn via conduit 228, are combined and routed, via conduit 230, to ethylene economizer 34 wherein the vapors function as coolant via indirect heat exchange means 58. The stream is then routed via conduit 232 from ethylene economizer 34 to the low-stage side of ethylene compressor 48.

As noted in FIG. 1, the compressor effluent from vapor introduced via the low-stage side is removed via conduit 234, cooled via inter-stage cooler 71, and returned to compressor 48 via conduit 236 for injection with the high-stage stream present in conduit 216. Preferably, the two-stages are a single module although they may each be a separate module and the modules mechanically coupled to a common driver. The compressed ethylene product from the compressor is routed to a downstream cooler 72 via conduit 200. The product from cooler 72 flows via conduit 202 and is introduced, as previously discussed, to the high-stage propane chiller 2.

The liquefied stream in conduit 122 is generally at a temperature of about −132° F. and a pressure of about 539 psi. This stream passes via conduit 122 to main methane economizer 74, wherein the stream is further cooled by indirect heat exchange means 76 as hereinafter explained. From main methane economizer 74 the liquefied gas passes through conduit 124 and its pressure is reduced by a pressure reduction means, which is illustrated as expansion valve 78, which evaporates or flashes a portion of the gas stream. The flashed stream is then passed to a methane high-stage flash drum 80 where it is separated into a gas phase discharged through conduit 126 and a liquid phase discharged through conduit 130. The gas-phase is then transferred to main methane economizer 74 via conduit 126 wherein the vapor functions as a coolant via indirect heat transfer means 82. The vapor exits main methane economizer 74 via conduit 128 where it is combined with the gas stream delivered by conduit 121. These streams are then fed to the high pressure inlet port of methane compressor 83.

The liquid phase in conduit 130 is passed through a second methane economizer 87 wherein the liquid is further cooled by downstream flash vapors via indirect heat exchange means 88. The cooled liquid exits second methane economizer 87 via conduit 132 and is expanded or flashed via pressure reduction means, illustrated as expansion valve 91, to further reduce the pressure and, at the same time, vaporize a second portion thereof. This flash stream is then passed to an intermediate-stage methane flash drum 92 where the stream is separated into a gas phase passing through conduit 136 and a liquid phase passing through conduit 134. The gas phase flows through conduit 136 to second methane economizer 87 wherein the vapor cools the liquid introduced to economizer 87 via conduit 130 via indirect heat exchanger means 89. Conduit 138 serves as a flow conduit between indirect heat exchange means 89 in second methane economizer 87 and indirect heat transfer means 95 in main methane economizer 74. This vapor leaves main methane economizer 74 via conduit 140 which is connected to the intermediate stage inlet on methane compressor 83.

The liquid phase exiting intermediate stage flash drum 92 via conduit 134 is further reduced in pressure by passage through a pressure reduction means, illustrated as a expansion valve 93. Again, a third portion of the liquefied gas is evaporated or flashed. The fluids from expansion valve 93 are passed to a final or low stage flash drum 94. In flash drum 94, a vapor phase is separated and passed through conduit 144 to second methane economizer 87 wherein the vapor functions as a coolant via indirect heat exchange means 90, exits second methane economizer 87 via conduit 146, which is connected to the first methane economizer 74 wherein the vapor functions as a coolant via indirect heat exchange means 96, and ultimately leaves main methane economizer 74 via conduit 148 which is connected to the low pressure port on compressor 83. The liquefied natural gas product from flash drum 94 which is at approximately atmospheric pressure is passed through conduit 142 to a LNG storage unit.

The low pressure, low temperature LNG boil-off vapor stream from the storage unit and optionally, the vapor returned from the cooling of the rundown lines associated with the LNG loading system, is preferably recovered by combining such stream or streams with the low pressure flash vapors present in either conduits 144, 146, or 148; the selected conduit being based on a desire to match vapor stream temperatures as closely as possible.

As shown in FIG. 1, the high, intermediate, and low stages of compressor 83 are preferably combined as single unit. However, each stage may exist as a separate unit where the units are mechanically coupled together to be driven by a single driver. The compressed gas from the low-stage section passes through an inter-stage cooler 85 and is combined with the intermediate pressure gas in conduit 140 prior to the second-stage of compression. The compressed gas from the intermediate stage of compressor 83 is passed through an inter-stage cooler 84 and is combined with the high pressure gas in conduit 140 prior to the third-stage of compression. The compressed gas is discharged from the high-stage methane compressor through conduit 150, is cooled in cooler 86, and is routed to high pressure propane chiller 2 via conduit 152, as previously discussed.

FIG. 1 depicts the expansion of the liquefied phase using expansion valves with subsequent separation of gas and liquid portions in the chiller or condenser. While this simplified scheme is workable and utilized in some cases, it is often more efficient and effective to carry out partial evaporation and separation steps in separate equipment, for example, an expansion valve and separate flash drum might be employed prior to the flow of either the separated vapor or liquid to a propane chiller. In a like manner, certain process streams undergoing expansion are ideal candidates for employment of a hydraulic expander as part of the pressure reduction means thereby enabling the extraction of work energy and also lower two-phase temperatures.

Table 1, below, shows selected temperatures and pressures of the fluid streams in various conduits throughout the prior art LNG facility illustrated in FIG. 1.

TABLE 1

Natural Gas Stream and Refrigerant Conditions
FIG. 1 - Prior Art

| Line/Conduit | Temperature (° F.) | Pressure (psia) |
|---|---|---|
| 100 | 99 | 630 |
| 102 | 62 | 577 |
| 110 | 25 | 572 |
| 112 | −29 | 566 |
| 116 | −90 | 553 |
| 118 | −105 | 547 |
| 120 | −111 | 546 |
| 122 | −132 | 539 |
| 124 | −139 | 534 |
| 142 | −250 | 15 |
| 200 | 246 | 285 |
| 216 | −5 | 77 |
| 232 | −5 | 23 |
| 300 | 144 | 203 |
| 306 | 57 | 104 |
| 311 | 22 | 56 |
| 320 | −32 | 17 |

Referring now to FIG. 2, an inventive cascade-type LNG plant constructed in accordance with a first embodiment of the present invention is schematically illustrated. The LNG facility illustrated in FIG. 1 employs a number of the same components as the prior art LNG facility described above with reference to FIG. 1. Thus, the common components of the LNG facility illustrated in FIG. 2 and the LNG facility illustrated in FIG. 1 are identically numbered. Generally, the identically numbered components in FIGS. 1 and 2 perform the same or similar functions. Thus, a description of the operation of each component illustrated in FIG. 2 will not be repeated.

Although the LNG facility illustrated in FIG. 2 shares many of the same components as the LNG facility illustrated in FIG. 1, one major difference between the two facilities is that the LNG facility illustrated in FIG. 2 employs a refrigerant comprising predominately carbon dioxide in the initial refrigeration cycle. Thus, in FIG. 2, conduits labeled with reference numerals in the 300's carry predominately carbon dioxide fluid streams. Employing a predominately carbon dioxide refrigerant in the first refrigeration cycle reduces the amount of volatile material present in the LNG facility and also enhances the overall efficiency of the facility. Because the thermodynamic and physical properties of carbon dioxide are significantly different than those of propane or propylene (i.e., the refrigerant used in the first refrigeration cycle illustrated in prior art FIG. 1) there are a number of differences between the prior art LNG facility illustrated in FIG. 1 and the inventive LNG facility illustrated in FIG. 2. For example, the inventive LNG facility illustrated in FIG. 2 includes an additional indirect heat exchange means 23 in chiller 22, an additional indirect heat exchange means 29 in chiller 28, an indirect additional heat exchange means 43 in chiller 42, an additional control valve 27 for controlling flow to conduit 154, and an additional control valve 33 disposed in conduit 112. In addition, the LNG facility illustrated in FIG. 2 includes new conduits 157, 159, 160, 162, 164, 165, 166, and 168.

Employing carbon dioxide (rather than propane or propylene) as the primary refrigerant of the first refrigerant cycle significantly changes certain operating conditions of the LNG facility. Table 2, below, shows selected temperature and pressure ranges of the fluid streams in various conduits throughout the inventive LNG facility illustrated in FIG. 2.

TABLE 2

Natural Gas Stream and Refrigerant Conditions
FIG. 2 - $CO_2/C_{2=}/C_1$ Refrigeration Cycles

| Line/ | Temperature Range (° F.) | | Pressure Range (psia) | |
|---|---|---|---|---|
| Con-duit | Preferred | More Preferred | Preferred | More Preferred |
| 100 | 30 to 150 | 60 to 120 | 500 to 1500 | 600 to 900 |
| 102 | 20 to 120 | 55 to 70 | 450 to 1400 | 550 to 850 |
| 110 | 5 to 80 | 10 to 35 | 450 to 1400 | 550 to 850 |
| 112 | 0 to −60 | −20 to −40 | 450 to 1200 | 550 to 850 |
| 113 | −10 to −80 | −30 to −45 | 400 to 1000 | 450 to 750 |
| 116 | −30 to −140 | −80 to −100 | 400 to 900 | 450 to 700 |
| 118 | −50 to −160 | −95 to −115 | 400 to 900 | 450 to 700 |
| 120 | −50 to −160 | −95 to −115 | 400 to 900 | 450 to 700 |
| 122 | −75 to −175 | −120 to −145 | 400 to 800 | 450 to 650 |
| 124 | −80 to −180 | −125 to −150 | 400 to 800 | 450 to 650 |
| 142 | −225 to −290 | −240 to −260 | 0 to 50 | 5 to 25 |
| 200 | 200 to 300 | 235 to 255 | 225 to 375 | 270 to 300 |
| 216 | 10 to −20 | 0 to −10 | 40 to 110 | 65 to 85 |
| 232 | 10 to −20 | 0 to −10 | 5 to 50 | 15 to 35 |
| 300 | 120 to 190 | 145 to 165 | >800 | 900 to 1100 |
| 306 | 40 to 70 | 50 to 60 | 600 to 800 | 675 to 750 |
| 311 | 5 to 35 | 15 to 25 | 325 to 525 | 400 to 450 |
| 320 | −10 to −60 | −25 to −40 | 100 to 225 | 140 to 190 |

Table 2 shows that the initial carbon dioxide refrigeration cycle of FIG. 2 operates at significantly higher pressures than the initial propane refrigeration cycle in the prior art system of FIG. 1. For example the discharge pressure from compressor 18 is much higher for the initial carbon dioxide refrigeration cycle shown in FIG. 2 than for the initial propane refrigeration cycle shown in FIG. 1. Carbon dioxide compressor 18 of FIG. 2 preferably provides a pressure increase across compressor 18 (i.e., from conduit 320 to conduit 300) of at least about 800 psi, more preferably 700–850 psi. Ethylene compressor 48 of FIG. 2, preferably provides a pressure increase across compressor 48 (i.e., from conduit 232 to conduit 200) of about 150–260 psi, more preferably 190–230 psi.

It is preferred for the LNG facility of FIG. 2 to provide for certain changes in the pressure and temperature of the natural gas stream across the carbon dioxide refrigeration cycle, the ethylene refrigeration cycle, the methane refrigeration cycle, and the expansion cycle. The temperature drop of the natural gas stream across the carbon dioxide refrigeration cycle (i.e., from conduit 100 to conduit 112) is preferably about 100–160° F., more preferably 120–140° F. The pressure drop of the natural gas stream across the carbon dioxide refrigeration cycle is preferably about 40–85 psi, more preferably 55–75 psi. The temperature drop of the natural gas stream across the ethylene refrigeration cycle (i.e., from conduit 114 to conduit 122) is preferably about 70–140° F., more preferably 90–120° F. The pressure drop of the natural gas stream across the ethylene refrigeration cycle is preferably about 10–80 psi, more preferably 30–60 psi. The temperature drop of the natural gas stream across the methane refrigeration cycle (i.e., from conduit 122 to conduit 124) is preferably about 1–20° F., more preferably 3–10° F. The pressure drop of the natural gas stream across the methane refrigeration cycle is preferably about 1–20 psi, more preferably 2–10 psi. The temperature drop of the natural gas stream across the expansion cycle (i.e., from conduit 124 to conduit 142) is preferably about 75–175° F., more preferably 95–125° F. The pressure drop of the natural gas stream across the expansion cycle is preferably about 300–650 psi, more preferably 500–550 psi.

When the LNG facility of FIG. 2 is operated at the conditions set forth above, the carbon dioxide refrigeration cycle (FIG. 2) has a significantly greater cooling capacity than the propane refrigeration cycle of the prior art LNG facility (FIG. 1). Indirect heat exchange means 23 and 29 are employed in the inventive LNG facility of FIG. 2 to help distribute excess cooling capacity of the carbon dioxide refrigeration cycle to the ethylene and methane refrigeration cycles, thereby enhancing efficiency. The cooling capacity of the carbon dioxide refrigeration cycle depends largely upon the temperature of the external environment used to cool the high pressure carbon dioxide refrigerant in cooler 20. For example, if cooler 20 uses ambient air to cool the carbon dioxide refrigerant, the cooling capacity of the propane refrigeration cycle will be significantly less when the outside air is hot than when the outside air is cold.

Control valve 27 can be adjusted in response to the temperature of the external environment to thereby adjust the amount of cooling capacity that is distributed from the carbon dioxide refrigeration cycle to the methane refrigeration cycle. Control valve 27 performs this function by controlling the amount of methane refrigerant that passes through heat exchange means 29. When the external environment is hot (i.e., when the carbon dioxide refrigeration cycle has minimal excess cooling capacity), control valve 27 can be opened to allow a significant portion (if not all) of the methane refrigerant flowing through conduit 162 to by-pass chiller 28 via conduits 164 and 166. This opening of control valve 27 transfers less cooling capacity from the carbon dioxide refrigeration cycle to the methane refrigeration cycle. When the external environment is cold (i.e., when the carbon dioxide refrigeration cycle has significant excess cooling capacity), control valve 27 can be closed to allow a significant portion (if not all) of the methane refrigerant in conduit 162 to flow through heat exchange means 29 of chiller 28 via conduits 165 and 168. This closing of control valve 27 transfers more cooling capacity from the carbon dioxide refrigeration cycle to the methane refrigeration cycle.

Control valve 33 can also be adjusted in response to the temperature of the external environment to thereby adjust the amount of cooling capacity that is distributed from the carbon dioxide refrigeration cycle to the ethylene refrigeration cycle. When the external environment is cold, control valve 33 can be opened to allow more of the excess cooling capacity of the carbon dioxide refrigeration cycle to shift to the ethylene refrigeration cycle. When the external environment is warm, control valve 33 can adjust pressure to allow less of the excess cooling capacity of the carbon dioxide refrigeration cycle to shift to the ethylene refrigeration cycle. In a preferred embodiment of the present invention, control valve 33 provides a pressure drop (i.e., a reduction in pressure from conduit 112 to conduit 114) of about 20–300 psi, more preferably 50–125 psi, and a temperature drop of about 0–50° F., preferably 5–20° F.

In addition to ambient temperature, another factor that can effect the manner in which control valves 27 and 33 are adjusted is the composition of the natural gas feed. If the natural gas feed is rich in heavy hydrocarbons, control valves 27 and 33 are adjusted to allow a small portion of the excess cooling capacity of the carbon dioxide refrigeration cycle to be distributed to the methane and ethylene cycles. If the natural gas feed is lean (i.e., almost all methane) control valves 27 and 33 are adjusted to allow a larger portion of the excess cooling capacity of the carbon dioxide refrigeration cycle to be distributed to the methane and ethylene cycles.

Referring again to FIG. 2, indirect exchange means 43 is added to chiller 42 to provide further cooling of the methane refrigerant with the ethylene refrigerant. The methane refrigerant cooled in heat exchange means 43 is conducted from an intermediate section of heat exchange means 97 in methane economizer 74 via conduit 157. After cooling in chiller 42, the cooled methane stream is transported via conduit 159 and combined with the methane stream in conduit 158. The combine methane stream from conduits 158 and 159 is then combined with the methane stream in conduit 120 immediately upstream of ethylene chiller/condenser 68.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention. For example, although FIGS. 1 and 2 only show LNG facilities employing an open methane cycle, it should be understood that LNG facilities employing closed methane cycles are within the ambit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A process for liquefying natural gas, said process comprising the steps of:

(a) cooling a natural gas stream in a first refrigeration cycle employing a first refrigerant comprising predominately carbon dioxide;

(b) downstream of the first refrigeration cycle, further cooling the natural gas stream in a second refrigeration cycle employing a second refrigerant comprising predominately methane, said first refrigeration cycle comprising separate first, second, and third carbon dioxide chillers for transferring heat between the natural gas stream and the first refrigerant, said second carbon dioxide chiller being located downstream of the first carbon dioxide chiller, said third carbon dioxide chiller being located downstream of the second carbon dioxide chiller, said first compressor including first, second, and third stage inlets for receiving the first refrigerant at different pressures, step (a) including conducting the first refrigerant from the first, second, and third carbon dioxide chillers to the first, second, and third stage inlets, respectively, step (a) including using the first, second, and third carbon dioxide chillers to cool the second refrigerant; and (c) diverting a portion of the second refrigerant cooled in the second carbon dioxide chiller around the third carbon dioxide chiller.

2. The process of claim 1; and (f) downstream of the second refrigeration cycle, further cooling the natural gas stream via expansion in an expansion cycle.

3. The process of claim 2, step (f) including reducing the pressure of the natural gas stream by about 300 to about 650 psi.

4. The process of claim 1, step (a) including using the first refrigeration cycle to cool at least a portion of the second refrigerant.

5. The process of claim 1, step (b) including using at least a portion of the natural gas stream as the second refrigerant.

6. The process of claim 1, said first refrigeration cycle comprising separate first, second, and third carbon dioxide chillers for transferring heat between the natural gas stream and the first refrigerant, said second carbon dioxide chiller being located downstream of the first carbon dioxide chiller, said third carbon dioxide chiller being located downstream of the second carbon dioxide chiller.

7. A process for liquefying natural gas, said process comprising the steps of:

(a) cooling a natural gas stream in a first refrigeration cycle employing a first refrigerant comprising predominately carbon dioxide; and (b) downstream of the first refrigeration cycle, further cooling the natural gas stream in a second refrigeration cycle employing a second refrigerant comprising predominately methane, said first refrigeration cycle comprising separate first, second, and third carbon dioxide chillers for transferring heat between the natural gas stream and the first refrigerant, said second carbon dioxide chiller being located downstream of the first carbon dioxide chiller, said third carbon dioxide chiller being located downstream of the second carbon dioxide chiller, step (a) including reducing the pressure of the first refrigerant between the first and second carbon dioxide chillers, step (a) including reducing the pressure of the first refrigerant between the second and third carbon dioxide chillers.

8. The process of claim 6, step (a) including using the first carbon dioxide chiller to cool at least a portion of the second refrigerant.

9. The process of claim 1, said first refrigeration cycle comprising a first compressor, step (a) including using the first compressor to increase the pressure of the first refrigerant to a discharge pressure of at least about 900 psia.

10. The process of claim 9, said first compressor including a low stage inlet for receiving the first refrigerant, step (a) including receiving the first refrigerant in the low stage inlet at a pressure of about 100 to about 225 psia.

11. The process of claim 1, step (a) including receiving the first refrigerant in the first stage inlet at a pressure of about 600 to about 800 psia, step (a) including receiving the first refrigerant in the second stage inlet at a pressure of about 325 to about 525 psia, step (a) including receiving the first refrigerant in the third stage inlet at a pressure of about 100 to about 225 psia.

12. The process of claim 1, step (a) including using the first refrigeration cycle to reduce the temperature of the natural gas stream by about 100 to about 160° F.

13. The process of claim 1; and (d) combining of the second refrigerant diverted around the third carbon dioxide chiller with the second refrigerant cooled in the third carbon dioxide chiller.

14. The process of claim 1; and (e) adjusting the amount of the third refrigerant diverted around the third carbon dioxide chiller.

15. The process of claim 1; and (g) downstream of the first refrigeration cycle and upstream of the second refrigeration cycle, cooling the natural gas stream in a third refrigeration cycle employing a third refrigerant comprising predominately ethane or ethylene.

16. The process of claim 15, step (h) including using the third refrigeration cycle to cool at least a portion of the second refrigerant.

17. A process for liquefying natural gas, said process comprising the steps of:

(a) cooling a natural gas stream in a first refrigeration cycle employing a first refrigerant comprising predominately carbon dioxide;

(b) downstream of the first refrigeration cycle, further cooling the natural gas stream in a second refrigeration cycle employing a second refrigerant comprising predominately methane;

(c) downstream of the first refrigeration cycle and upstream of the second refrigeration cycle, cooling the natural gas stream in a third refrigeration cycle employing a third refrigerant comprising predominately ethane or ethylene; and (d) downstream of the first refrigeration cycle and upstream of the third refrigeration cycle, reducing the pressure of the natural gas stream by about 20 to about 300 psi.

18. The process of claim 1; and (h) vaporizing liquefied natural gas produced via steps (a) and (c).

19. A process for liquefying natural gas, said process comprising the steps of:

(a) cooling a natural gas stream in a carbon dioxide refrigeration cycle employing a plurality of separate chillers for sequentially transferring heat from the natural gas stream to a carbon dioxide refrigerant comprising predominately carbon dioxide, said carbon dioxide refrigeration cycle including a carbon dioxide compressor for increasing the pressure of the carbon dioxide refrigerant to a discharge pressure of at least about 900 psia; and (b) downstream of the carbon dioxide refrigeration cycle, further cooling the natural gas stream in a methane refrigeration cycle employing a methane refrigerant comprising predominately methane.

step (a) including reducing the pressure of the carbon dioxide refrigerant between each of the chillers so that the pressure of the carbon dioxide refrigerant in the chillers decreases incrementally from an upstream-most one of the chillers to a downstream-most one of the chillers.

20. The process of claim 19; and (c) downstream of the methane refrigeration cycle, further cooling the natural gas stream via expansion in an expansion cycle.

21. The process of claim 20, step (c) including reducing the temperature of the natural gas stream to a temperature of about −225 to about −290° F. and the pressure of the natural gas stream to a pressure of about 0 to about 50 psia.

22. The process of claim 19, said carbon dioxide refrigerant comprising at least about 75 mole percent carbon dioxide, said methane refrigerant comprising at least about 75 mole percent methane.

23. The process of claim 19, step (b) including employing at least a portion of the natural gas stream as the methane refrigerant.

24. The process of claim 19, step (a) including using the upstream-most one of the chillers to cool at least a portion of the methane refrigerant.

25. The process of claim 19; and (d) vaporizing liquefied natural gas produced via steps (a) and (b).

26. A process for liquefying natural gas, said process comprising the steps of:

(a) cooling a natural gas stream in a carbon dioxide refrigeration cycle employing a plurality of separate chillers for sequentially transferring heat from the natural gas stream to a carbon dioxide refrigerant comprising predominately carbon dioxide, said carbon dioxide refrigeration cycle including a carbon dioxide compressor for increasing the pressure of the carbon dioxide refrigerant to a discharge pressure of at least about 800 psia;

(b) downstream of the carbon dioxide refrigeration cycle, further cooling the natural gas stream in an ethylene refrigeration cycle employing an ethylene refrigerant comprising predominately ethylene;

(c) downstream of the ethylene refrigeration cycle, further cooling the natural gas stream in a methane refrigeration cycle employing a methane refrigerant comprising predominately methane; and (d) downstream of the carbon dioxide refrigeration cycle and upstream of the ethylene refrigeration cycle, reducing the pressure of the natural gas stream by about 20 to about 300 psi.

27. The process of claim 26, said natural gas stream exiting the carbon dioxide refrigeration cycle at a temperature of about 0 to about −60° F. and a pressure of about 450 to about 1200 psia.

28. The process of claim 27, said natural gas stream exiting the ethylene refrigeration cycle at a temperature of about −75 to about −175° F. and a pressure of about 400 to about 800 psia.

29. The process of claim 28; and (f) downstream of the ethylene refrigeration cycle further, cooling the natural gas stream via expansion in an expansion cycle.

30. The process of claim 29, step (f) including reducing the temperature of the natural gas stream to a temperature of about −225 to about −290 ° F. and the pressure of the natural gas stream to a pressure of about 0 to about 50 psia.

31. The process of claim 26, said carbon dioxide refrigerant comprising at least about 75 mole percent carbon dioxide, said ethylene refrigerant comprising at least about 75 mole percent ethylene, said methane refrigerant comprising at least about 75 mole percent methane.

32. The process of claim 26, step (c) including employing at least a portion of the natural gas stream as the methane refrigerant.

33. The process of claim 26, step (a) including using the carbon dioxide refrigeration cycle to reduce the temperature of the natural gas stream by about 100 to about 160° F.

34. The process of claim 26, step (a) including using the plurality of chillers to cool at least of portion of the methane refrigerant.

35. The process of claim 34, step (b) including using the ethylene refrigeration cycle to cool at least a portion of the methane refrigerant.

36. The process of claim 26; and (e) cooling the carbon dioxide refrigerant discharged from the carbon dioxide compressor in a cooler that is operable to transfer heat from the carbon dioxide refrigerant to an external environment; and step (d) including reducing the pressure of the natural gas stream by an amount dependent upon the temperature of the external environment or the composition of the natural gas stream.

37. The process of claim 26, said plurality of chillers including first, second, and third chillers, said second chiller being positioned downstream of the first chiller, said third chiller being positioned downstream of the second chiller, said carbon dioxide compressor including first, second, and third stage inlets for receiving the carbon dioxide refrigerant at different pressures, step (a) including conducting the carbon dioxide refrigerant from the first, second, and third chillers to the first, second, and third stage inlets, respectively.

38. The process of claim 37, step (a) including using the first, second, and third chillers to cool the methane refrigerant.

39. A process for liquefying natural gas, said process comprising the steps of:

(a) cooling a natural gas stream in a carbon dioxide refrigeration cycle employing a plurality of separate chillers for sequentially transferring heat from the natural gas stream to a carbon dioxide refrigerant comprising predominately carbon dioxide, said carbon dioxide refrigeration cycle including a carbon dioxide compressor for increasing the pressure of the carbon dioxide refrigerant to a discharge pressure of at least about 800 psia;

(b) downstream of the carbon dioxide refrigeration cycle, further cooling the natural gas stream in an ethylene refrigeration cycle employing an ethylene refrigerant comprising predominately ethylene;

(c) downstream of the ethylene refrigeration cycle, further cooling the natural gas stream in a methane refrigeration cycle employing a methane refrigerant comprising predominately methane.

said plurality of chillers including first, second, and third chillers, said second chiller being positioned downstream of the first chiller, said third chiller being positioned downstream of the second chiller, said carbon dioxide compressor including first, second, and third stage inlets for receiving the carbon dioxide refrigerant at different pressures, step (a) including conducting the carbon dioxide refrigerant from the first, second, and third chillers to the first, second, and third stage inlets, respectively, step (a) including using the first, second, and third chillers to cool the methane refrigerant; and (d) routing at least a portion of the methane refrigerant cooled in the second chiller around the third chiller.

40. The process of claim 39; and (e) combining the methane refrigerant routed around the third chiller with the methane refrigerant cooled in the third chiller.

41. The process of claim 39; and (f) varying the amount of the methane refrigerant routed around the third chiller.

42. The process of claim 26, step (a) including receiving the carbon dioxide refrigerant in the first stage inlet at a pressure of about 600 to about 800 psia, step (a) including receiving the carbon dioxide refrigerant in the second stage inlet at a pressure of about 325 to about 525 psia, step (a) including receiving the carbon dioxide refrigerant in the third stage inlet at a pressure of about 100 to about 225 psia.

43. The process of claim 42, step (a) including using the first, second, and third chillers to reduce the temperature of the natural gas stream by 120 to 140° F.

44. The process of claim 26; and (g) vaporizing liquefied natural gas produced via steps (a)–(d).

45. A LNG product produced by the process of claim 1.

46. A LNG product produced by the process of claim 18.

47. A LNG product produced by the process of claim 25.

48. A LNG product produced by the process of claim 25.

49. A LNG product produced by the process of claim 44.

50. A LNG product produced by the process of claim 44.

51. A LNG plant for liquefying a natural gas stream, said LNG plant comprising:

a carbon dioxide refrigeration cycle comprising a carbon dioxide compressor, a carbon dioxide chiller, and a carbon dioxide refrigerant comprising predominately carbon dioxide, said carbon dioxide compressor being operable to increase the pressure of the carbon dioxide refrigerant, said carbon dioxide chiller being operable to transfer heat from the natural gas stream to the carbon dioxide refrigerant, a methane refrigeration cycle comprising a methane compressor, a methane chiller, and a methane refrigerant comprising predominately methane, said methane compressor being operable to increase the pressure of the methane refrigerant, said methane chiller being operable to transfer heat from the natural gas stream to the methane refrigerant;

an ethylene refrigeration cycle comprising an ethylene compressor, an ethylene chiller, and ethylene refrigerant comprising predominately ethylene, said ethylene compressor being operable to increase the pressure of the ethylene refrigerant, said ethylene chiller being operable to transfer heat from the natural gas stream to the ethylene refrigerant, said ethylene refrigeration cycle being disposed downstream of the carbon dioxide refrigeration cycle and upstream of the methane refrigeration cycle; and an adjustable pressure reducer for reducing the pressure of the natural gas stream, said adjustable pressure reducer being disposed downstream of the carbon dioxide refrigeration cycle and upstream of the ethylene refrigeration cycle.

52. The LNG plant of claim 51; and an expansion cycle for receiving the natural gas from the methane chiller, said expansion cycle comprising a plurality of pressure reducers for sequentially reducing the pressure of the natural gas stream.

53. The process of claim 15, step (g) including using the third refrigeration cycle to reduce the temperature of the natural gas stream by about 70 to about 140° F.

* * * * *